United States Patent [19]

Nerone

[11] Patent Number: 4,928,038

[45] Date of Patent: May 22, 1990

[54] POWER CONTROL CIRCUIT FOR DISCHARGE LAMP AND METHOD OF OPERATING SAME

[75] Inventor: Louis R. Nerone, Brecksville, Ohio

[73] Assignee: General Electric Company, Schenectady, N.Y.

[21] Appl. No.: 248,882

[22] Filed: Sep. 26, 1988

[51] Int. Cl.[5] ..... H05B 39/04

[52] U.S. Cl. ..... 315/209 R; 315/307; 315/DIG. 4; 315/DIG. 7

[58] Field of Search ..... 315/209 R, 209 T, 224, 315/307, 308, DIG. 4, DIG. 7

[56] References Cited

U.S. PATENT DOCUMENTS 4,137,484 1/1979 Osteen ..... 315/209 R 4,749,913 6/1988 Stuermer et al. ..... 315/175

*Primary Examiner*—David Mis

*Attorney, Agent, or Firm*—John P. McMahon; Stanley C. Corwin; Fred Jacob

[57] ABSTRACT

Circuits, and methods of using the same, are disclosed for controlling the power supplied to a discharge lamp of the type having a closed inductive loop, such as the resonant ballast circuit for a fluorescent lamp or the inductive ballast loop of a high pressure sodium lamp, wherein the closed inductive loop is operated by an electrical power supply having a d-c input stage and an output power controlled by the switching frequency of a switch means within the power supply itself whereby current flows to the closed inductive loop when the switch means is conductive and no current flows from the power supply to the closed loop when the switch means is non-conductive. This power control circuit comprises means for sensing the instantaneous current flowing through the switch means itself, means controlled by this instantaneous current for creating a first signal with a value that is proportional to the actual power being supplied by the power supply to the closed loop, means for creating a second signal with a value proportional to the desired set point power for the lamp, means for creating an error signal having a value indicative of the difference between the first and second signals, and means for adjusting the switching frequency of the switch means in accordance with the value of the error signal, whereby the output power of the power supply is continuously adjusted toward the set point power for controlling the power actually supplied to the lamp circuit irrespective of the parameters of the lamp circuit itself. The disclosed circuits provide for constant power to a high pressure discharge lamp to yield a constant color temperature. Further, the disclosed circuits provide for dimming of the discharge lamp to selective power levels.

38 Claims, 11 Drawing Sheets

$$(1)\ P_{IN} = \frac{\int_{t_b}^{t_a} V(t)\cdot i(t)\,dt}{nT}$$

$$(2)\ \therefore P_{IN} = \frac{V_b \int_{t_b}^{t_a} i(t)}{nT} = V_b I_0$$

$$(3)\ P_{IN} = \frac{P_L}{EFFICIENCY}$$

$$(4)\ P_L = k I_0$$

$$(1)\ P_{IN} = \frac{\int_{t_b}^{t_a} V(t) \cdot i(t)\,dt}{nT}$$

$$(2)\ \therefore P_{IN} = \frac{V_b \int_{t_b}^{t_a} i(t)}{nT} = V_b I_0$$

$$(3)\ P_{IN} = \frac{P_L}{EFFICIENCY}$$

$$(4)\ P_L = k I_0$$

(5) $V_{G1} \propto + V_{b/2}$ (6) $V_{G2} \propto - V_{b/2}$ (7) $P_L = \frac{1}{T}\int_{ta}^{tb} v(t)\,i(t)\,dt$ (8) $P_L = V_b \frac{1}{T}\int_{ta}^{tb} i(t)\,dt$ (9) $I_0 \equiv \frac{1}{T}\int_{ta}^{tb} i(t)\,dt$

(10) $P_L = V_b\, I_0$

POWER CONTROL CIRCUIT FOR DISCHARGE LAMP AND METHOD OF OPERATING SAME

The present invention relates to the art of power supplies for discharge lamps and more particularly to a power control circuit for a discharge lamp, and the method of operating this control circuit, for accurately controlling the power supplied to the lamp. Such control circuit can be employed for a constant illumination power or an adjustable, but constant, dimming power.

INCORPORATION BY REFERENCE

The present invention has general application to various electrical discharge lamps of the type where power is supplied to a closed inductive loop, either for the purpose of maintaining a constant illumination power or for dimming the lamp to a fixed adjustable power. In the preferred embodiment, the discharge lamp is a high pressure sodium lamp of the general type disclosed in U.S. Pat. No. 4,137,484 of Osteen which is incorporated by reference herein as a background showing of one lamp for using the present invention. In accordance with one embodiment of the invention, power is supplied to the ballast circuit of the high pressure sodium lamp, in a run mode of operation Wherein the lamp current is successively increased by an input current pulse from the power supply and is then allowed to decrease through a free wheeling diode to maintain a given light intensity during the run mode. A circuit employing similar features is generally described in U.S. Pat. No. 4,749,913 of Stuermer et al. which is also incorporated by reference herein. These two patents respectively disclose a lamp and a power supply with a run mode for driving the lamp as generally employed in the preferred embodiment of the invention.

BACKGROUND OF THE INVENTION

The present invention is particularly adapted for maintaining a constant power to an high pressure sodium vapor lamp, as shown in Osteen 4,137,484, with a power supply having an operating mode using a similar run mode concept as disclosed in Stuermer et al. 4,749,913 and will be described with respect thereto; however, the invention has much broader application and may be used to maintain a constant power to an electric discharge lamp for the purpose of maintaining a selected intensity with its related constant color temperature or it may be employed for the purpose of controlled dimming to a fixed, but adjustable, power level of a discharge lamp, such as fluorescent lamp having a resonant ballast circuit. Both of these environments, for which the invention is particularly applicable, require a power supply capable of producing a fixed, or constant, power applied across the discharge lamp so that the intensity of the lamp can be controlled. When dimming of the lamp is the objective of the control circuit, the power across the lamp must be adjustable over a relatively wide range while maintaining consistency, good power factor control and uniform lighting, even at low power settings. When a constant power is required, such as in a system for controlling the intensity of an high intensity discharge lamp, it is necessary that the applied power across the lamp remain constant as the lamp ages and as the line voltage fluctuates. Both of these objectives, i.e. a constant power and a fixed adjusted power, can be obtained by a power control system having the capabilities of maintaining a power at a preselected level irrespective of the changes in the operating parameters of the lamp circuit. Consequently, a relatively inexpensive power control circuit accomplishing these objectives has been sought in the lamp industry for some time.

To provide power control to a discharge lamp, it has been suggested that the actual lamp current could be sensed with a current transformer and a voltage signal proportional to the lamp current could be electrically summed with a voltage signal proportional to the desired constant power or adjusted dimming power so as to produce a feedback signal applied to the input of a voltage controlled oscillator so that the frequency of the oscillator will be changed to track the lamp current with the desired power. Such a feedback system does not accurately control lamp power. Instead, the lamp current is maintained constant and power fluctuates with the lamp voltage which could vary, appreciably between individual lamps and their related life. In this prior feedback system, lamp intensity is controlled by the lamp current; however, such a system is not wholly satisfactory since the lamp intensity is not proportional to the lamp current, but is proportional to the instantaneous lamp power. As can be seen, this suggested lamp current feedback approach for controlling the lamp intensity at a dimmed level, or constant level, will not accomplish the objective of maintaining a constant lamp power or constant lamp intensity with its related constant color temperature. As the lamp ages its operating voltage increases and the power applied to the lamp increases accordingly. Use of such a feedback system reduces the life of the lamp by causing the voltage across the lamp to increase as it ages.

Such current controlled feedback systems are generally economical; however, they do not produce accurate dimming when used for that purpose in a fluorescent lamp system. At low adjusted intensity levels, fluctuations in the power through the lamp can be sufficient to extinguish a fluorescent lamp. The same defifiency is found when driving an High Intensity Discharge (HID) lamp wherein the desired optimum power level, balancing light intensity and lamp life, cannot be accurately controlled by sensing lamp current and providing the feedback through a voltage control oscillator of a current mode control system.

Some of the difficulties experienced in prior efforts to control the power to discharge lamps by the lamp current as disclosed generally in Stuermer et al. 4,749,913 could be substantially improved by combining the lamp voltage and current to produce a signal having a level controlled by the instantaneous lamp power and then employing this power signal in a feedback loop for adjusting the power supply to maintain a constant lamp power. The disadvantage of this power feedback approach is that the cost of a power circuit at the lamp itself is extremely high and would contribute adversely to the cost of such a power feedback system.

In summary, the art of power supplies for discharge lamps has a need for a system that can deliver to an HID lamp a constant power to provide a constant color temperature in spite of variations in lamp voltage. In addition, if such a system could also be adjustable to provide for dimming of a lamp, such as a fluorescent lamp, it would be even more advantageous to this field.

THE INVENTION

The present invention relates to a power control circuit that will provide a constant power necessary for maintaining the desired color temperature of an HID lamp, which can also maintain a fixed power, adjustable over a wide range of values to facilitate controlled dimming of discharge lamps, such as fluorescent lamps having a resonant ballast circuit.

In accordance with the invention, a power control circuit is provided, which circuit maintains a constant power across the lamp itself without the need for instantaneous voltage measurement across the lamp. This system has the ability of allowing less than 1% fluctuations for variations in the lamp voltage and less than 2% fluctuations in power for the minor variations of the line voltage to the power supply. In summary, the power control circuit, and method of using the same, employed in accordance with the present invention maintains a constant power at the lamp without the expense, inconvenience, inefficiency and bulk necessary for measuring the instantaneous voltage across the lamp.

In accordance with the present invention, there is provided a power control circuit for a discharge lamp in a closed inductive loop and operated by an electrical power supply having a d-c input stage with a given voltage and an output power controlled by the switching frequency of a power switch means in the power supply, whereby the d-c current flows to the control loop when the switch means is conductive and no current flows from the power supply to the control loop when the switch means is non-conductive. The power control circuit comprises means for sensing the actual current flowing through the switch means and means, controlled by the sensed switch current, for creating a first signal with a value proportional to the actual power being supplied by the power supply to the closed loop. By detecting and sensing the current flowing through the power switch itself, the applied power to the lamp, represented by the feedback signal, can be determined without the variations of the operating characteristics of the lamp itself. This unique, novel feedback signal is used to control the power supply.

MATHEMATICAL ANALYSIS

The broadest aspect of the invention is based upon a mathematical determination that the average current $I_o$ through the switch means of the power supply is proportional to the lamp power. This can be illustrated mathematically using a standard d-c chopper or buck converter, to be discussed, for driving a high intensity discharge lamp shown in FIG. 1. Switch current or sensed current $I_S$, includes a series of current pulses which can be processed electrically to produce a voltage signal $V_o$ indicative of the input power Pin to the power supply from a d-c link. This input power is mathematically determined to be an integration of the product of the magnitude of voltage V(t) and the switch current i(t) as shown in equation (1) on FIG. 1. Current i(t) is the instantaneous current resulting from the converter action of the power supply. Such integration of V(t)i(t)dt is accomplished between ta, tb for a period defined by a number of operating cycles T. This provides a value indicative of the input power Pin. Since the magnitude of the d-c link voltage $V_b$ can be assumed to be constant for mathematical analysis, the input power Pin of the power supply varies in direct proportion to the sensed instantaneous current i(t) in the secondary of the power supply as shown in equation (2). This current is directed toward the lamp driving circuit and includes a plurality of current pulses CP to be described. The power of the lamp $P_L$ is essentially the magnitude of the d-c input stage voltage $V_b$ times the average switch current $I_o$ divided by the generally constant efficiency of the power supply itself. The relationship between the functions Pin, $P_L$ and the Efficiency of the supply is given in equation (3). The relationship between $P_L$ and $I_o$ is expressed in equation (4) having a constant K that includes $V_b$ and the Efficiency quantity of equation (3). Since the Efficiency is relatively high and remains constant and the d-c link voltage $V_b$ remains essentially constant, the power to the lamp $P_L$ is a variable of the average sensed switch current $I_o$ passing through the power switch to be described. Current $I_o$ is an integral of instantaneous current resulting from the converter action over a preselected number of cycles n which instantaneous current can be approximated by a trapezoidal current pulse CP and is indicative of the average current $I_o$ through the switch. By sensing switch current and passing it as voltage signal $V_S$ through a low pass filter, a voltage signal proportional to the average sensed current $I_o$ may be extracted by the low pass filter. Thus, the output of the low pass filter becomes a voltage signal $V_o$ having a value proportional to the actual power $P_L$ being supplied by the power supply to the closed loop. This is the first signal or unique feedback signal used in and forming an important part of the invention.

USE OF SIGNAL $I_o$

In the present invention, the averaged current $I_o$ described in conjunction with the mathematical analysis is employed as a first signal which is proportional to or represents the actual power used by the lamp. This first signal is summed with a second signal having a value proportional to a set point power for creating an error signal having a value indicative of the difference between the first and second signals. A switching frequency of the power supply is adjusted in accordance with the value of the error signal so that the output power of the power supply is continuously adjusted toward a set point power. In accordance with the invention, a sensed current $I_S$ is developed and averaged into a voltage signal $V_o$ which is employed as a power control feedback signal. This particular signal $V_o$ is not affected by the lamp circuit itself so that the power directed toward the lamp is maintained constant in a control system for a discharge lamp constructed in accordance with the invention, without the need for measuring the voltage across the actual lamp itself.

In accordance with another aspect of the invention, the invention can be used to control dimming of a light system. In a preferred embodiment of this use of the invention, a pair of oppositely poled switching devices responsive to appropriate gating signals are employed as the power supply for a fluorescent lamp system having a resonant ballast circuit including the secondary of a transformer. Current, in response to the appropriate gating signals, is sensed in the primary of the transformer as an indication of the current flowing in the lamp in opposite directions corresponding to the gating signals. By combining these opposite flowing current signals during two opposed operating phases a control current $I_o$ is developed. This current signal $I_o$ is passed through a low pass filter to produce voltage signal $V_o$, which is summed with a set point signal and then amplified by an error amplifier. This error signal is used as a feedback signal for controlling the power applied to the fluorescent lamp by changing the switching frequency of the oppositely poled switching devices. In this manner, the power of the lamp is controlled in a manner similar to the circuit and method by which power is controlled at a constant value for a high intensity discharge lamp, as previously explained. This specific use of the invention is a second, alternative embodiment of the invention and employes the broadest concept of the present invention. However, control of the high intensity discharge HID lamp by a current sensed signal from the power supply is the preferred embodiment of the present invention.

In accordance with still another aspect of the invention, a high intensity discharge lamp is controlled by the broadest aspect of the invention, i.e. creation of feedback signal $V_o$ discussed in connection with the mathematical analysis. In this particular use of the invention, a current control means is employed for creating a series of operating cycles T having a first driven portion W wherein the switch of the power supply is rendered alternately conductive and non-conductive in succession and a acquiescent portion T-W wherein the switch is non-conductive. Thus, this aspect of the invention uses the broad concept of a feedback signal $V_o$ for controlling lamp power in a system supplying power to a high intensity lamp, such as a high pressure sodium lamp. The power control circuit using this aspect of the invention includes a succession of unique, novel operating cycles T. The time of the first driving portion W with respect to the total time of the operating cycle T, i.e. the duty cycle W/T, is adjusted in accordance with the error signal representing the difference between the set point power and the power signal derived from the signal $V_o$. By adjusting the duty cycle of the operating cycles T there is provided a unique arrangement for controlling the total power supplied to a high intensity lamp to maintain a desired, constant color temperature for the lamp. In accordance with a further aspect of this portion of the invention, the length of the first driven portion W in the operating cycle T is adjusted by changing the frequency at which the switch is alternated between conductive and non-conductive states during the first driven portion W of the operating cycle T. By maintaining a fixed number N of switch alternations in the driven portion W of the operating cycle T and employing the error signal to change the frequency of switch alternations, the duty cycle W/T is adjusted without abrupt termination or chopping of the input power from the power supply to the lamp circuit.

In accordance with another aspect of the invention, a novel method is obtained for controlling the power of a discharge lamp utilizing the power control circuit, as defined above.

The primary object of the present invention is the provision of a power control circuit, and method of using the same, for driving a discharge lamp, which circuit and method maintain a constant power at the lamp, irrespective of variations in the characteristics of the lamp and without circuits for detection of these characteristics, such as varying voltage across the lamp.

Another object of the present invention is the provision of a circuit and method, as defined above, which circuit and method control the power within at least about 2% upon variations in lamp voltage and variations of input voltage to the power supply. Indeed, power control within less than about 1% is possible upon variations in the lamp voltage.

Yet another object of the present invention is the provision of a circuit and method, which circuit and method can be employed for maintaining a constant power across the lamp and for fixing the power directed to a discharge lamp at an adjusted fixed level for the purposes of dimming the lamp.

Still a further object of the present invention is the provision of a circuit and method, as defined above, which circuit and method control lamp power in a manner to compensate for both voltage variations across the lamp and input voltage variations to the power supply.

Another object of the present invention is the provision of a circuit and method, as defined above, which circuit and method are relatively inexpensive to produce and can be used with a variety of discharge lamps wherein the power to the lamp is controlled by varying the frequency of the power supply.

These and other objects and advantages will become apparent from the following description taken together with the accompanying drawings.

DESCRIPTION OF THE PREFERRED EMBODIMENTS

Figure 1:
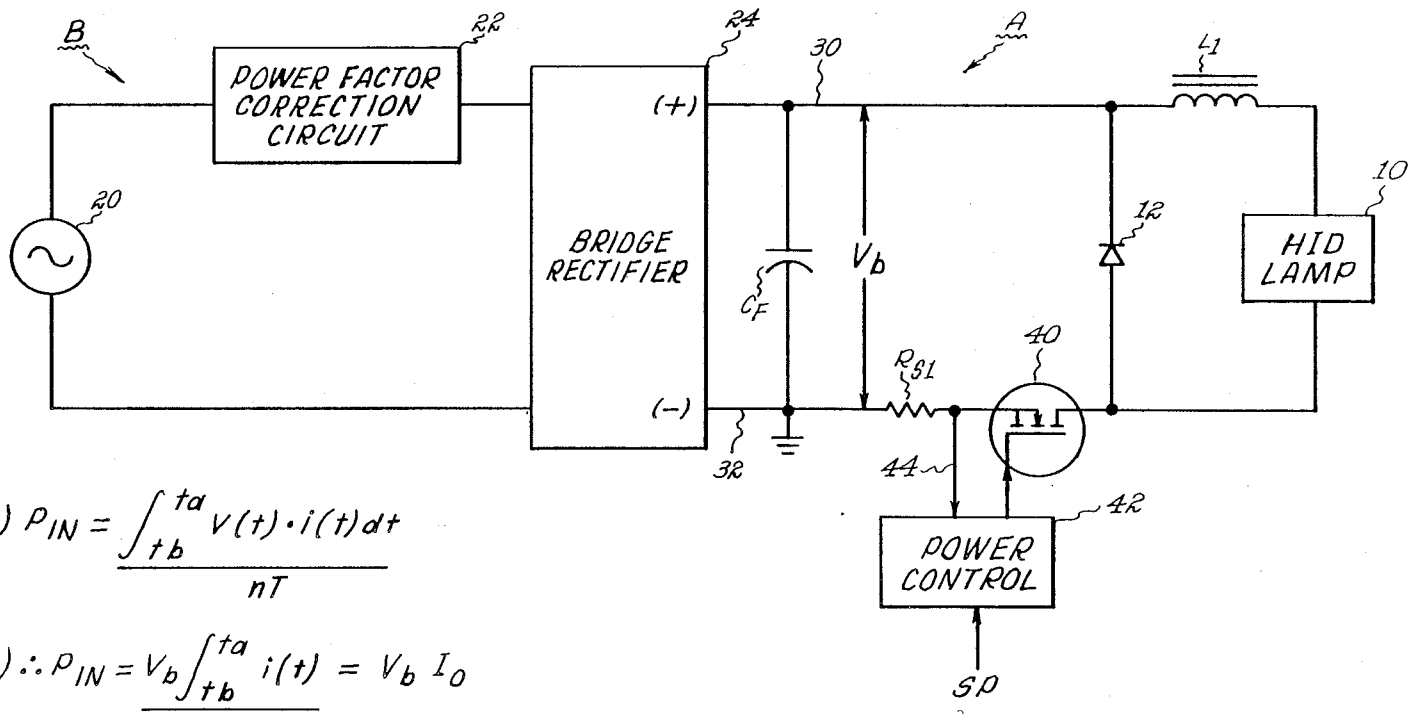
FIG. 1 is a block diagram showing the preferred embodiment of the present invention for operating a high intensity lamp (HID), such as high pressure sodium lamp.

Referring now to the drawings wherein the showings are for the purpose of illustrating preferred embodiments of the invention and not for the purpose of limiting same, FIG. 1 shows an HID lamp system A including a high pressure sodium lamp 10 with a ballast inductance $L_1$ having a typical value of 350 micro henries and a freewheeling diode 12. In accordance with standard practice, excitation is supplied to the lamp, inductance and diode by a plurality of spaced pulses CP, to be discussed with regard to FIG. 7, from a power supply PS. This power supply includes an input stage B illustrated as having line voltage supply 20, a normal power factor correcting circuit 22 and a full wave bridge rectifier 24 having an output filter shown as $C_F$. The input stage produces a d-c link which is a relatively ripple free d-c voltage $V_b$ across output leads 30 and 32. Power supply PS includes a buck converter or d-c chopper comprising the inductor $L_1$, diode 12, sensing resistor $R_{S1}$, and power FET 40 which is responsive to a generally shown power control circuit 42 comprised of circuit elements to be described with regard to FIG. 3. The buck converter directs current from the d-c link $V_b$ to the lamp circuit when FET 40 is in its conductive state and blocks current flow from the d-c link to the lamp circuit when power FET 40 is in its non-conductive state. Power is directed to the lamp circuit by alternately rendering the power FET, or control switch 40, conductive and non-conductive with the amount of lamp power $P_L$ being generally proportional to the relative time that the switch means or power FET 40 is conductive as compared to when it is non-conductive.

The mathematical analysis discussed in the introductory portion is outlined in the equations associated with FIG. 1. Switch current through the power FET is sensed as signal $I_S$ to produce a signal $I_o$ which is equal to the lamp power $P_L$ multiplied by a constant K. The power Pin supplied by the d-c link to the loop including lamp 10 is equal to the lamp power $P_L$ divided by the efficiency of the power converter related to the circuitry of FIG. 1.

To sense the current through switch means 40, the sensing resistor $R_{S1}$ having a typical value of 0.13 ohms is employed at the input side of switch 40 so that power control circuit 42, constructed in accordance with the present invention, receives a voltage signal $V_S$ in line 44 generally indicative of the instantaneous current through switch means 40. By adjusting the set point SP of power control 42, best shown in FIG. 3, the voltage signal $V_S$ in line 44 can be employed for controlling the frequency of operation of power switch 40 for the purpose of adjusting the power $P_L$ of the lamp circuit to track the set point SP. Thus, by merely sensing the current, power to the lamp circuit $P_L$ is maintained at the set point SP irrespective of parameter changes within the ballast circuit including the lamp 10, inductor $L_1$ and diode 12. Maintaining this power at a constant value, in turn, provides for a constant color temperature for the lamp 10.

Figure 3:
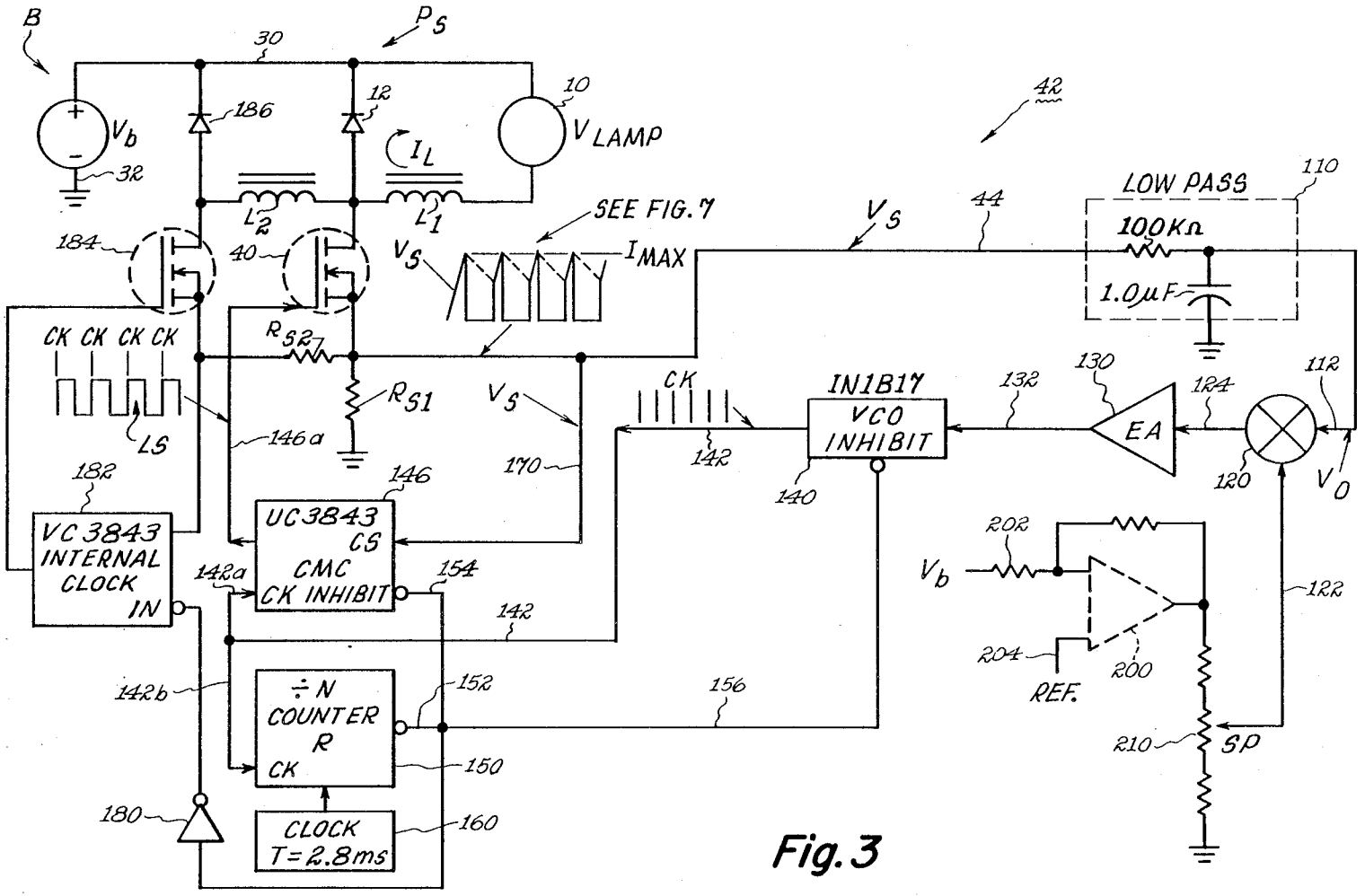
FIG. 3 is a block diagram and partial wiring diagram illustrating the preferred embodiment of the present invention.

The power control 42 of FIG. 1 is shown as comprising a plurality of circuit elements interconnected in a manner as shown in FIG. 3. Referring now in more detail to FIG. 3, the switching current $I_S$ is sensed at resistor $R_{S1}$ so as to develop a voltage signal $V_S$. Signal $V_S$ is illustrated as the trapezoidal, solid line wave shape adjacent sense line 44 and is shown in more detail in FIG. 7. The signal $V_S$ on line 44 is a voltage representative of the current directed from power supply PS to the lamp circuit.

As developed mathematically, the time based integration of the switch current, i.e. signal $I_S$, is indicative of or represents the actual power $P_L$ being supplied by power supply $P_S$ to the lamp. The direct relationship between this integration and the lamp power $P_L$ is not affected by the lamp itself. The instantaneous sensed current signal $I_S$ is routed to a low pass filter 110 having a resistor and capacitor illustrated in FIG. 3 and an output 112 for directing a signal $V_o$ which is essentially representative of the average of signal $I_S$. The output signal $V_o$ has a value proportional to the actual power being directed to the lamp circuit. This voltage $V_o$ in line 112 is directed to one terminal of a summing junction 120 having a second terminal connected to the set point (SP) line 122. The signal in output line 124 of summing junction 120 is the difference or error between the actual power $P_L$ directed to the lamp circuit, as indicated by a first voltage signal ($V_o$) on line 112, and the set point power SP represented by a second voltage signal (SP) on line 122. This error or difference signal is amplified by a standard error amplifier EA 130 to produce an amplified error signal in line 132. The level of this amplified error signal is indicative of the difference between the set point power SP and the actual power being provided to the lamp circuit, as expressed by $P_L = KI_o$, and is not affected by the parameter changes in the lamp itself.

Creation of the unique, novel error signal in line 124 is the broadest aspect of the present invention and is used in the various embodiments. Amplification of the signal to produce the amplified error signal in line 132 is also employed in all embodiments of the present invention to control the frequency of the switching means in the power supply PS for forcing the actual power $P_L$ of the lamp $P_L$ toward the set point power SP. When constant power is desired, such as for operation of an HID lamp, SP is a fixed value. When the invention is used for dimming, such as in a fluorescent lamp system, SP is adjusted to the desired lamp light level.

In accordance with another aspect of the invention, as shown in the preferred embodiment of FIG. 3, the switching frequency 1/P of power switch 40 is adjusted to track $P_L$ with $I_o$. This concept is accomplished by a voltage to frequency converter or voltage controlled oscillator (VCO-IN1B17) 140 having an output 142 with a frequency controlled by the voltage level of the amplified error signal in line 132. Output 142 contains a series of logic pulses CK with a period P and a frequency 1/P. These pulses are directed to a line **142*a* 1/P for clocking a standard current mode control chip 146 (UC 3843 of Unitrode) having an output logic signal LS present on line 146*a* which controls the actual operation of the power FET 40. A pulse CK in line 142*a* causes a logic change in logic signal LS in line 146*a* to render power FET 40 conductive. At the same time, a signal in line 142*b* generated by VCO 140 clocks or decrements a counter 150, which is preset to 25. A second clock 160 which may be a self oscillating circuit or a stable multivibrator provides at an appropriate time duration T which, in the preferred embodiment, is 2.8 ms and which presets counter 150 to 25. This 2.8 duration defines the operating cycle T of the waveform shown in FIG. 2. Consequently, the leading edge of the first occurrence of a signal CK in line 142 during a given operating cycle T, starts the operating cycle by clocking current mode control 146. Power switch means 40 is shifted to the conductive state by a change in logic in signal LS. At this time, a pulse or signal in line 142*b* decrements digital counter 150. Each successive signal or pulse CK in line 142 renders switch means 40 conductive, if it is not already conductive, and decrements counter 150. After counter 150 decrements to zero from the preset number of 25, an inhibit signal is created in output line 152. This signal inhibits voltage control oscillator 140 and inhibits current mode control 146. Thus, after 25 counts or pulses CK have been created in line 142 during a given operating cycle T, power switch 40 is no longer shifted into the conductive state and signal LS remained at the OFF logic. Line 156 inhibits VCO 140 so no further pulses CK are received in the line 142. Consequently, the VCO and current mode chip 146 are synchronized and started in unison after timer 160 has timed out to reset counter 150. When clock device 160 times out (2.8 ms) to complete operating cycle T, counter 150 is preset to 25 and the inhibit signal in lines 152, 154 and 156 are removed. The discussed response to the signal on line 132 is then repeated for the next operating cycle T. As so far described, an ON logic is created in line 146a in response to a pulse CK to initiate conductivity of switch means 40. The switch is conductive as long as this ON logic condition of signal LS is retained on line 146a. This ON logic in signal LS is retained until chip 146 is shifted to an OFF condition, which, in turn, shifts signal LS to the OFF logic. In accordance with standard practice, the OFF logic is created when the level of current $I_S$ represented as $V_S$ in line 44 reaches a preselected value corresponding to a maximum current level set into chip 146. Signal $V_S$ is introduced into chip 146 at compare terminal CS through line 170. Thus, when switch 40 is rendered conductive by a pulses CK and LS, current is directed from the d-c link $V_b$ to lamp 10 until a maximum current $I_{max}$ is reached as determined by the voltage in line 170. When that condition occurs, the voltage level in line 170 is sensed by chip 146 so as to change the logic of signal LS which turns off power FET 40. Pulse CK turns the switch on and obtainment of the current Imax turns the switch off. This is accomplished by signals into terminals CK and CS, respectively of chip 146**.

Figure 2:
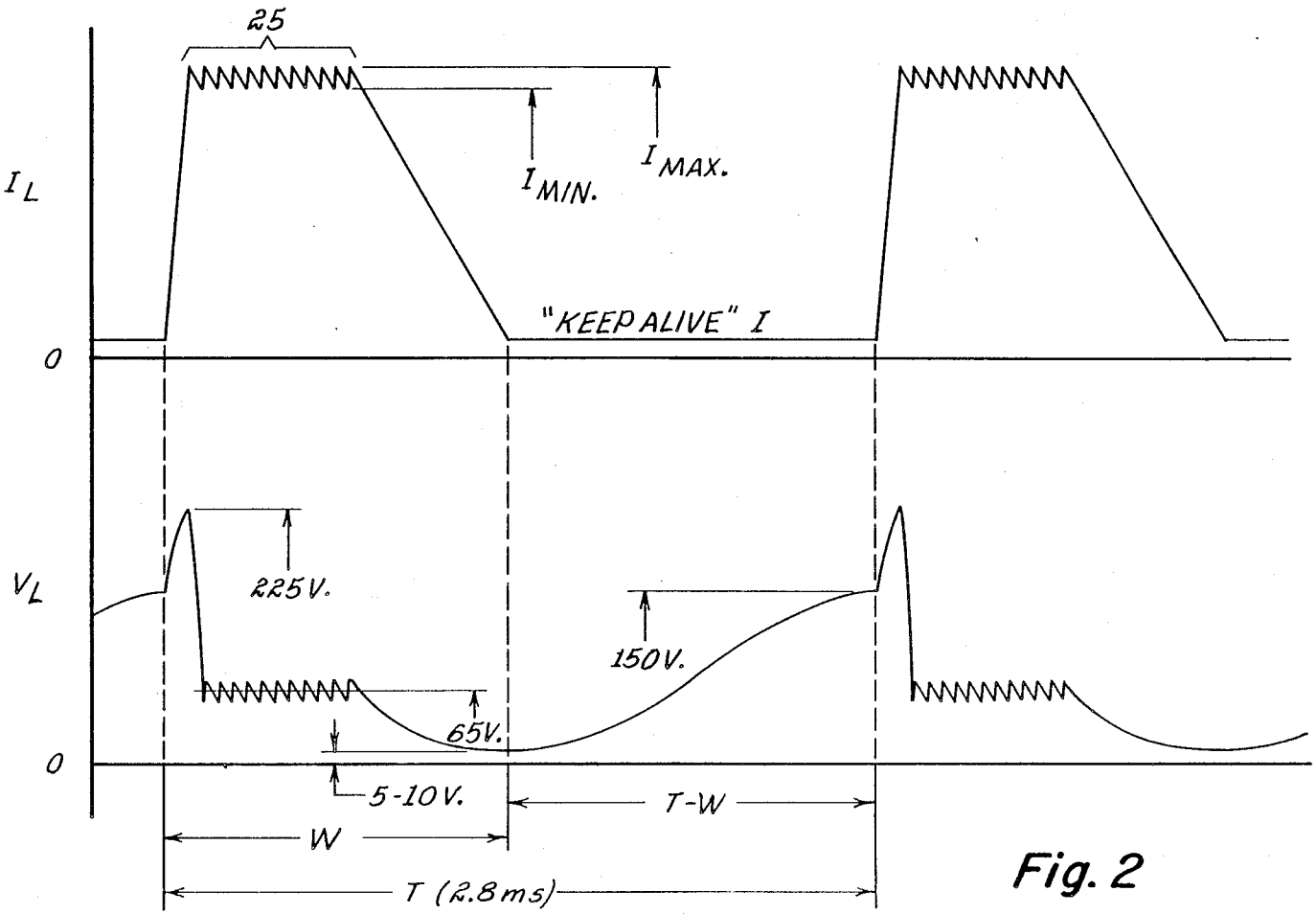
FIG. 2 is a graph illustrating the lamp current and lamp voltage related to a control circuit employing the preferred embodiment of the present invention.

The hereinbefore described circuit is related to supplying the main current to the lamp 10, whereas, a "keep alive" current shown in FIG. 2 for the lamp 10 is provided by the operation of an inverter 180, clock device 182, power FET device 184, diode 186, a second sensing resistor $R_{S2}$ of a typical value such as 8.2 ohms and a inductor $L_2$ having a typical value of 85 millihenries. The clock device 182 has an internal clock and may be of a type and operation as the standard current mode control chip 146 previously described. In operation, inverter 180 in response to the inhibit signal generated by clock 150 and present on line 15 activates clock device 182. Clock device 182 controls FET 184 in a similar manner as described for chip 146 controlling FET 40 with the exception that the voltage signal deterministic of when device 182 is turned off is controlled by sensing resistor $R_{S2}$ sensing a current ("keep alive") which, in turn, is determined primarily by the value of inductor $L_2$. Further details of the keep alive current along with the main current previously discussed with regard to FIG. 3 may be described with reference to FIG. 2.

FIG. 2 illustrates the general operation of the preferred embodiment shown in FIG. 3. When power FET 40 is first rendered conductive during an operating cycle T, the lamp current $I_L$ immediately rises according to the voltage across inductance $L_1$. Thus, current $I_L$ rises rapidly. The lamp voltage $V_L$ shown in the lower graph of FIG. 2 also rises rapidly to restart or maintain the arc condition of the HID lamp 10 at a high voltage illustrated in the graph as approximately 225 volts. After the arc condition has been reestablished, the lamp current as sensed in line 44 reaches a maximum level $I_{max}$ which is detected as a voltage in line 170. When this maximum current is reached, switch means 40 is rendered non-conductive. The logic on line 146a shifts. The lamp current $I_L$ then starts to decrease along a more gradual slope as the current free wheels. Thereafter, the logic on line 146a is shifted to turn switch 40 on when a pulse CK is created at the output of oscillator 140. This logic shift created by pulse CK causes the switch means 40 to again be conductive. Switch 40 shifts between conducting and non-conducting for a preset number of times, illustrated as N=25. Counter 150 times out at 25 pulses CK and inhibits oscillator 140 and inhibits further shifts in logic on line 146a by chip 146. When counter 150 decrements to zero, the driven portion W of cycle T expires. The lamp current shifts to the "keep alive" current developed by the related circuit elements of FIG. 3. The lamp voltage $V_L$ gradually recovers to approximately 150 volts awaiting the start of the driving portion W in the next successive operating cycle T.

In summary, as shown in FIG. 2, the operating cycle T includes an initial driving portion W followed by a quiescent portion T-W. Clock device 160 starts the next cycle T at portion W by presetting counter 150 to 25. The duty cycle of operating cycle T is W/T; therefore, as the length of W is adjusted by changing frequency 1/P, the duty cycle is changed to adjust the lamp power $P_L$. To change the time based length of portion W, the frequency of the pulses CK in line 142 is varied by oscillator 140. The width of portion W changes with the frequency change of the VCO since the number N of counter 150 is fixed.

Figure 4:
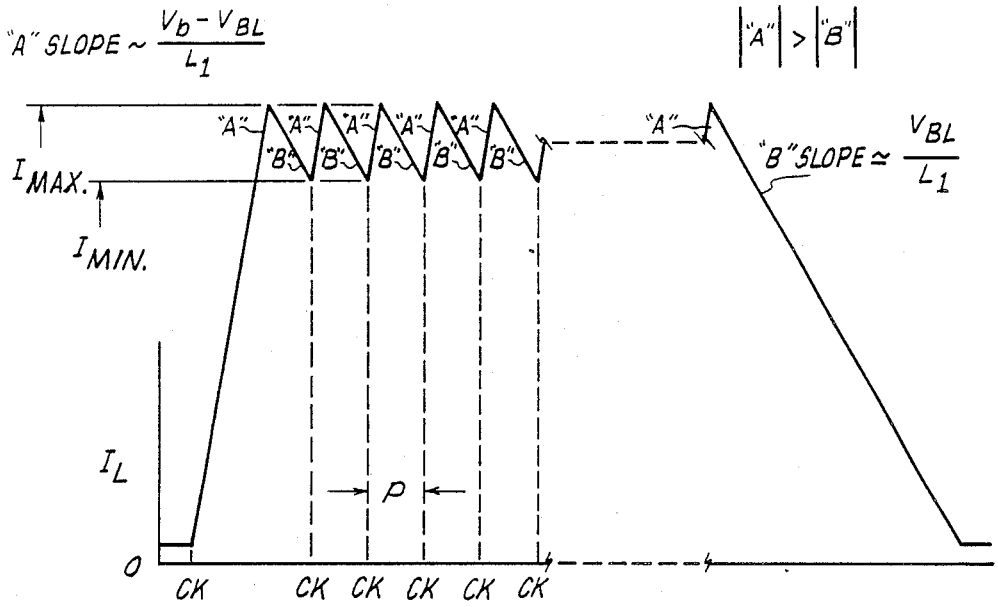
Fig. 4 (PRIOR ART)
FIG. 4 is an enlarged current curve showing operating characteristics of a prior art current mode control system for applying power to an high intensity discharge lamp.
Figure 5:
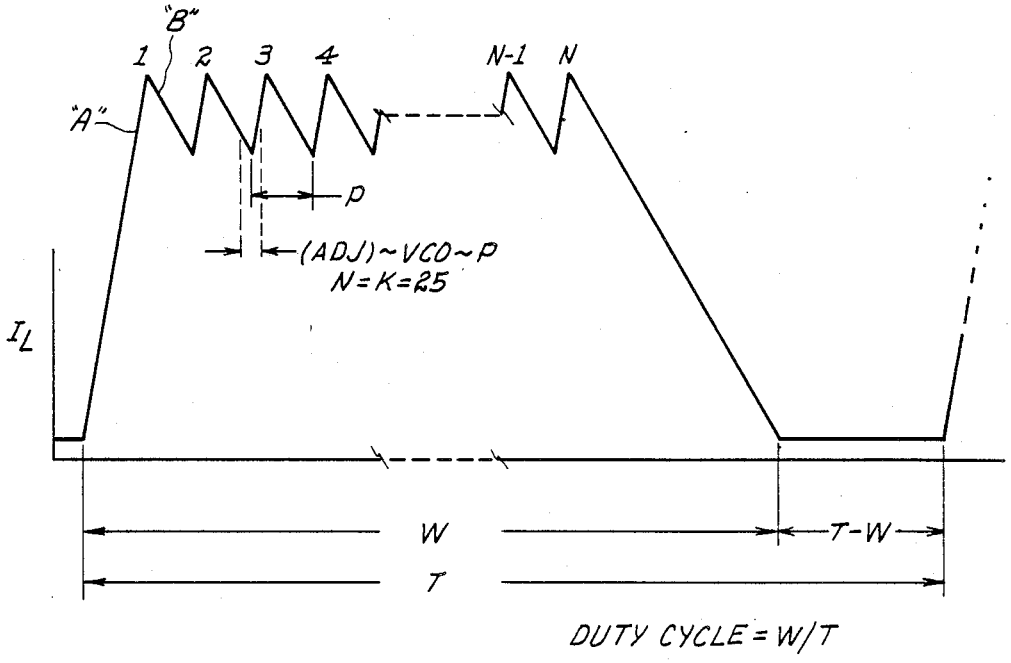
FIG. 5 is a current curve, similar to FIG. 4, illustrating an operating characteristic of the preferred embodiment of the present invention.

The operating characteristics of the present invention and prior art devices are respectively shown in FIGS. 5 and 4. FIG. 4 shows the normal manner by which a prior art current mode control operates during the run mode for directing power to a discharge lamp. When the power switch is conductive, lamp current IL progresses along the initial line at a slope A controlled by (1) the d-c link voltage $V_b$, and (2) the voltage $V_{BL}$ across the ballast inductor $L_1$ which is determined by its inductance value. As soon as lamp current $I_L$ has increased to the maximum current $I_{max}$, switch 40 is rendered non-conductive and the lamp current decreases along slope B which is substantially less than slope A. As shown on FIG. 4, slope A is expressed as the difference $(V_b - V_{BL})$ divided by the value of inductance $L_1$, whereas, slope B is expressed as the quantity $V_{BL}$ divided by the value of inductance $L_1$. As taught by prior art patent of Stuermer et al. 4,749,913, when operating in the run mode using a current mode operation that takes into account $I_{max}$ and $I_{min}$, a switch, such as FET 40, can be again rendered conductive when the lamp current reaches to a minimum current $I_{min}$ so that the lamp current obtains $I_{max}$ and $I_{min}$ in a cyclic manner.

Another concept for operating the current mode control is to allow the current to decrease until the logic on the FET has been shifted by a clock pulse CK on terminal CK of a current mode control chip, such as chip 146. Thus, switch means 40 is made conductive by spaced pulses CK and not by the decreasing of the lamp current to a minimum level $I_{min}$. In accordance with the prior power circuits using a current mode chip, the alternation of the current between increase and decrease, no matter how the increase was started, was continued for the total run cycle of the lamp. The conductive logic on a signal line, similar to LS, was created by either reaching a minimum lamp current $I_{min}$ or by the creation of a next pulse. This concept of causing the lamp current to increase and then allowing it to free wheel and decrease by using a current mode control chip is employed as a control feature during a fixed periodic duration of the lamp operation. The overall operating cycle T of the power control circuit d2, shown generally in FIG. 1 and having the logic mechanization of FIG. 3, is generally illustrated in FIG. 2 and is shown in more detail in FIG. 5.

The difference between FIG. 4 and FIG. 5 is that the present invention, shown in FIG. 5, employs an operating cycle T which is not a continuous or fixed run mode as that of the prior art type illustrated in FIG. 4. After a given number N of pulses from VCO 140, portion W which encompasses the overall duration of the waveform of lamp current $I_L$ is terminated and power supply PS shifts into a quiescent portion which covers the remainder of cycle T until the next cycle T is started by clock device 160.

As illustrated graphically in FIG. 5, an aspect of the invention is the creation of a duty cycle power control for the lamp. By adjusting the frequency 1/P of the pulses CK, the time active driven portion W with respect to the overall time of cycle T is increased or decreased. Of course, the length of portion W could be adjusted by a timer which would terminate the driven portion W at an adjustable time controlled by the sensed power derived from the current $I_S$. This could cause a chopping effect that would distort the trailing end of the power portion W and cause the lamp to flicker. By using the aspect of the present invention wherein the number N remains the same and the power from power supply PS is adjusted by changing the frequency of the pulses CK in line 146*a* in accordance with the sensed, actual power, a smooth power control operation is accomplished while obtaining accurate control of the power.

As so far described, set point SP is a fixed or constant voltage level. In accordance with an added, or optional, feature of the present invention, set point SP can be adjusted in accordance with the actual input line voltage that causes certain minor variations in the d-c voltage $V_b$. To accomplish this secondary objective, as shown in FIG. 3, an operational amplifier 200 has the level of voltage $V_b$ as an input through resistor 202. A reference voltage signal in line 204 allows variations in the d-c voltage to shift the upper portion of SP voltage divider 210. This causes slight adjustment in the set point SP voltage signal in line 122. In FIG. 3, set point SP is illustrated to be adjustable through a rheostat or pot. This feature can be employed for dimming the lamp; however, in a high intensity discharge lamp, a constant power is desired so the adjustment of SP at the rheostat can be made to optimize between illumination and lamp life. By employing a feedback from the d-c voltage $V_b$, as well as the power indicating current signal $I_o$, power has been controlled within 1% based upon lamp operating voltage variations and 2% based upon line voltage variations.

In summary, the invention, in its broadest aspects, involves the creation of a signal $I_o$ by the power supply PS, which signal is indicative of actual current flow through the switch 40, which, in turn is indicative of the power supplied to the lamp 10 i.e. $P_L = KI_o$. In accordance with an aspect of the invention, this sensed, process current signal $I_o$, which is developed into a voltage level signal, is compared to a set point voltage level. The difference in these voltage levels adjusts the frequency employed for operating the switch means 40. This gives a feedback loop for controlling power in accordance with the sensed current signal $I_o$. In accordance with still a further aspect of the present invention, and for use with a high intensity discharge lamp, the duty cycle W/T concept of FIGS. 2 and 5 is employed wherein the first driving or power portion W has a fixed number N of current pulses. The current pulses in power portion W stop and await a restarting of the lamp current during the next power portion. The duty cycle is adjusted by changing the frequency 1/P of the CK pulses in response to the lamp current variations.

Figure 6:
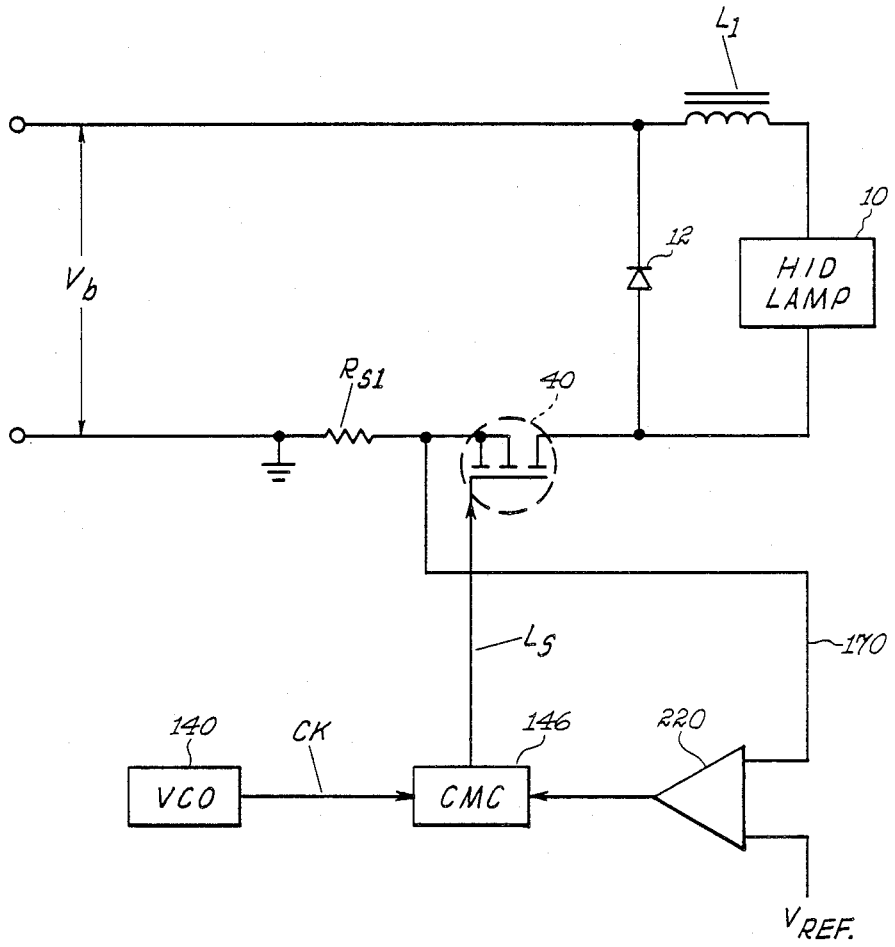
FIG. 6 is a block diagram showing operating characteristics of the preferred embodiment, as illustrated in FIG. 3.

The general operation of the invention is schematically illustrated in FIG. 6 in its most simple form. The power control FET 40 is controlled by logic signal LS from a pulse duration regulator 146. Comparator circuit 220 of chip 146 is illustrated as a separate component to show its mode of operation. When the current $V_S$ sensed in line 170 exceeds a reference level, comparator 220 turns off the power switch 40. The power switch is then turned on by a pulse CK from voltage controlled oscillator 140. Since the maximum lamp current is also the maximum current through switch 40, the sensed voltage in line 170 is used for toggling comparator 220. This feature is illustrated better in FIG. 7 wherein the solid line pulses CP1–CPN are the spaced current pulses through switch 40 during each driving portion W. During the current pulse CP1, switch 40 is initiated. This pulse charges inductance $L_1$. Since the maximum current $I_{max}$ is not reached during the first current pulse CP1, the next clocking pulse CK in line 142*a* will not change the operation of the switch 40 which is still already conductive. Switch 40 becomes non-conductive when the maximum lamp current $I_{max}$ is reached. When that occurs, switch 40 is rendered non-conductive. This produces the trapezoidal wave of FIG. 7 having the slopes A and B previously discussed with regard to FIG. 4. The dash line between the current pulses CP1-CPN indicates that the lamp current $I_L$ shifts between the maximum level $I_{max}$ and a level flowing through the lamp 10 that is present during by the next occurring, successive pulse CK. In this illustration pulse CP1 overlaps the second clock pulse CK; therefore, the number of pulses will be N−1. The important feature is that the number of clock pulses CK=N. This variation is realized when indicating that the number of pulses equals N.

In accordance with the invention, power control 42 generally illustrated in FIG. 1 senses the current $I_S$ flowing through switch 40 which is representative of the current flowing in the lamp and at times is indicative of the maximum lamp current $I_{max}$, that is, the same as both the lamp current and the switch current. For that reason, the current $I_S$ in line 102 can be employed through line 170 for the purpose of rendering switch means 40 non-conductive at chip 146.

Figure 7:
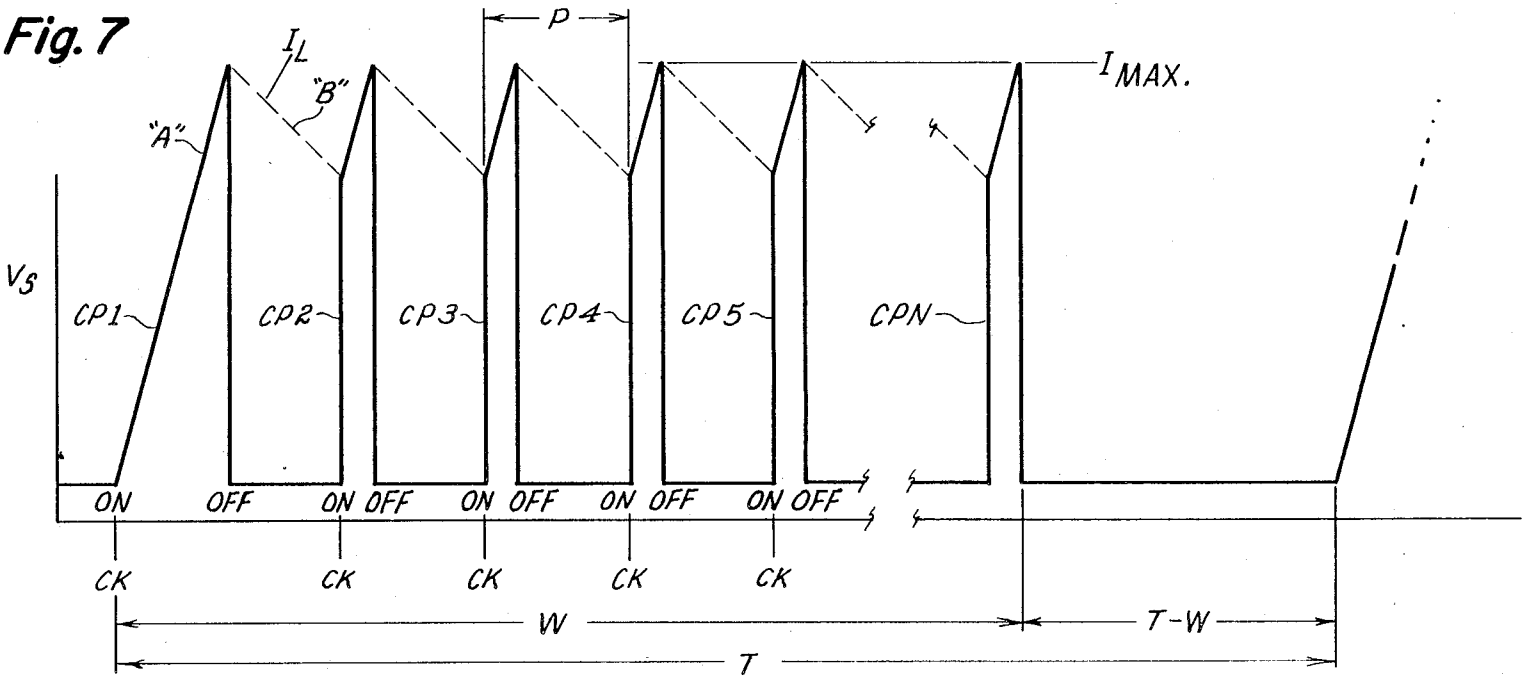
FIG. 7 is a curve showing the voltage signal $V_S$ employed in accordance with the present invention.
Figure 8:
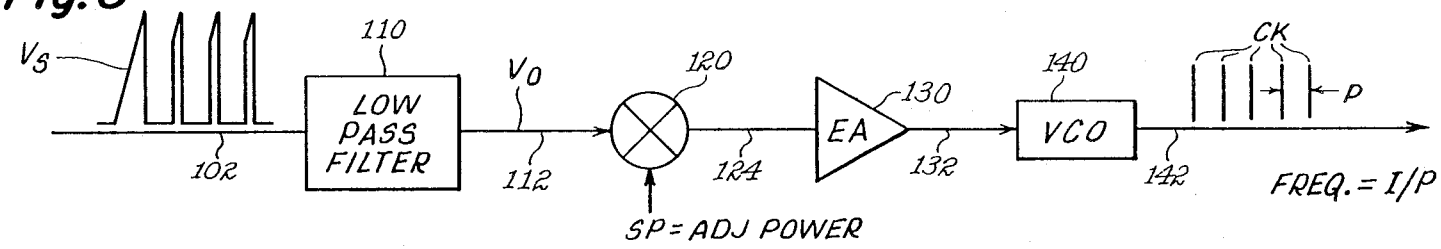
FIG. 8 is a block diagram showing the common aspects of the present invention adapted for use in both preferred embodiments of the invention.

FIG. 8 illustrates components employed in both preferred embodiments of the invention to allow a sensed current $I_S$ to be read as the actual power $P_L$ consumed in the lamp circuit. By passing the wave shape of $V_S$ shown in FIG. 7 through the low pass filter 110, the d-c level or first signal $V_o$ is created in line 112. This first signal is used as a feedback to cause a change in the frequency 1/P of the pulses CK in line 142 by comparison with a second signal SP indicative of the SET POINT power desired for lamp 10. FIGS. 7 and 8 taken together with FIG. 3 illustrate the basic power control concept used in both preferred embodiments of the present invention.

Figure 9:
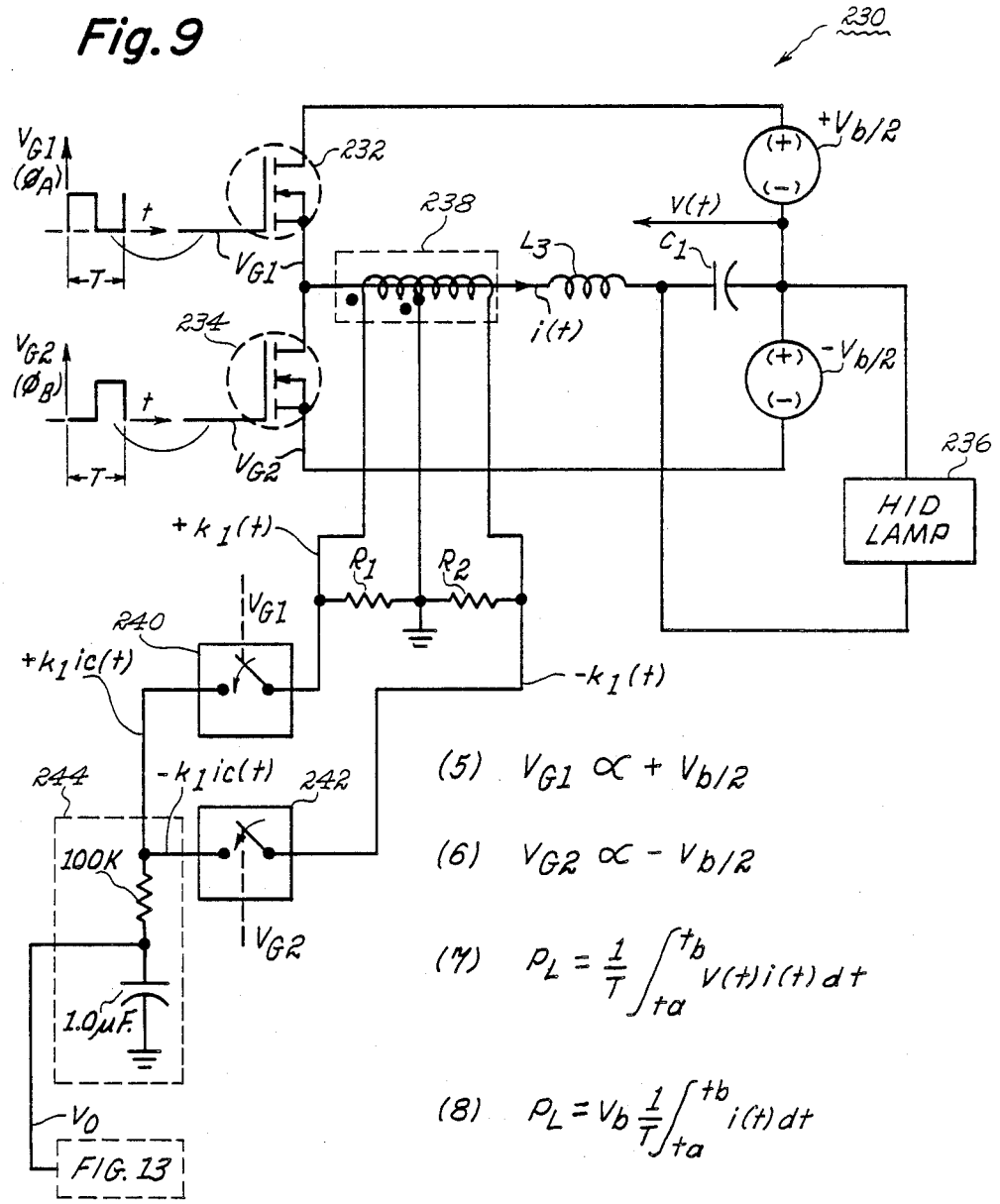
FIG. 9 is a block diagram of the present invention employed as a dimming circuit for a fluorescent discharge lamp.

The present invention can be used to control the power to a fluorescent lamp as illustrated in FIGS. 9–13. FIG. 9 is a schematic of a circuit arrangement 230 comprising two power FET 232 and 234 having gate drive voltage $V_{G1}$ ($\phi_A$) and $V_{G2}$ ($\phi_B$) respectively applied to their gate electrode. The FET 234 and 234 are commoned as shown in FIG. 9 to provide a node therebetween and which node is routed to one end of inductor $L_3$ of a typical value of 2.8 millihenries which has its other end connected to a capacitor C having typical value of 2.2 nanofarads, which, in turn, has its other end connected to the node formed between two d-c line voltage $+V_{b/2}$ and $-V_{b/2}$ shown in FIG. 9 and also to one end of a fluorescent lamp 236, which, in turn, has its other end connected to a node formed by $L_3$ and $C_1$. The values of components $L_3$ and $C_1$ primarily determine the resonant frequency of the resonant circuit of lamp 236. The two d-c link $V_{b/2}+V_{b/2}$ and $-V_{b/2}$ are similar to the previously discussed $V_b$ but of one-half the value have their polarities arranged in an opposite manner as shown in FIG. 9.

The circuit arrangement 230 further comprises a center tapped transformer 238, having dot indicated polarities, and which is coupled to the current i(t) flowing into inductor $L_3$. The output windings of transformer 238 are respectively separated from each other by resistors $R_1$ and $R_2$ with each having one end connected to the grounded center tap of transformer 238 and arranged to provide two current quantities $k_1(t)$ and $-k_1(t)$ which are respectively routed to analog switch devices 240 and 242. The devices 240 and 242 are respectively gated by voltages $V_{G1}$ and $V_{G2}$ and correspondingly generate quantities $k_1i_c(t)$ and $-k_1i_c(t)$ which are connected or summed together at the output of devices 240 and 242 and routed to a low pass filter 244 to produce the quantity $V_o$, which, in turn, is routed to the circuit arrangement of FIG. 13 to be described.

The operation of circuit arrangement 230 may be described by first referring to expressions (5), (6), (7), (8), (9) and (10) of FIG. 9 in relation to the circuit arrangement of FIG. 9. The operation of switches FET 232 and 234 effectively allow $V_{G1}$ to be proportional to $+V_{B/2}$ and $V_{G2}$ (equation (5)) to be proportional to $-V_{B/2}$ (equation (6)). When FET 232 is rendered conductive the voltage V(t) shown in equation (7) is representative of $V_{G1}$, whereas, when FET 234 is rendered conductive the voltage V(t) is representative of $V_{G2}$. If the quantity V(t) is constant over an interval of $t_b-t_a$, which is one-half of a duration T, then the power $P_L$ of the lamp 236 may be expressed by equation (8). If the quantity $I_o$ (directly related to $V_o$) is defined as shown in equation (9), then the lamp power $P_L$ may be expressed as equation (10).

The operation of the circuit arrangement 230 may be further described with reference to FIG. 10 consisting of FIGS. (*a*); (*b*); (*c*); (*d*); (*e*); and (*f*) respectively illustrative of the functions $k_1(t)-k_1(t)$; $K_{1c}$; $V_{G1}$ proportional to $V_{b/2}$; $V_{G2}$ proportional to $-V_{b/2}$; $-k_1ic(t)$; and $V_o$. The first portion of $V_o$ of FIG. 10(*f*) is related to FIGS. 10(*a*), 10(*b*), and 10(*c*), whereas, the second portion of $V_o$ of FIG. 10(*f*) is related to FIGS. 10(*a*), 10(*d*) and 10(*e*).

Figure 10:
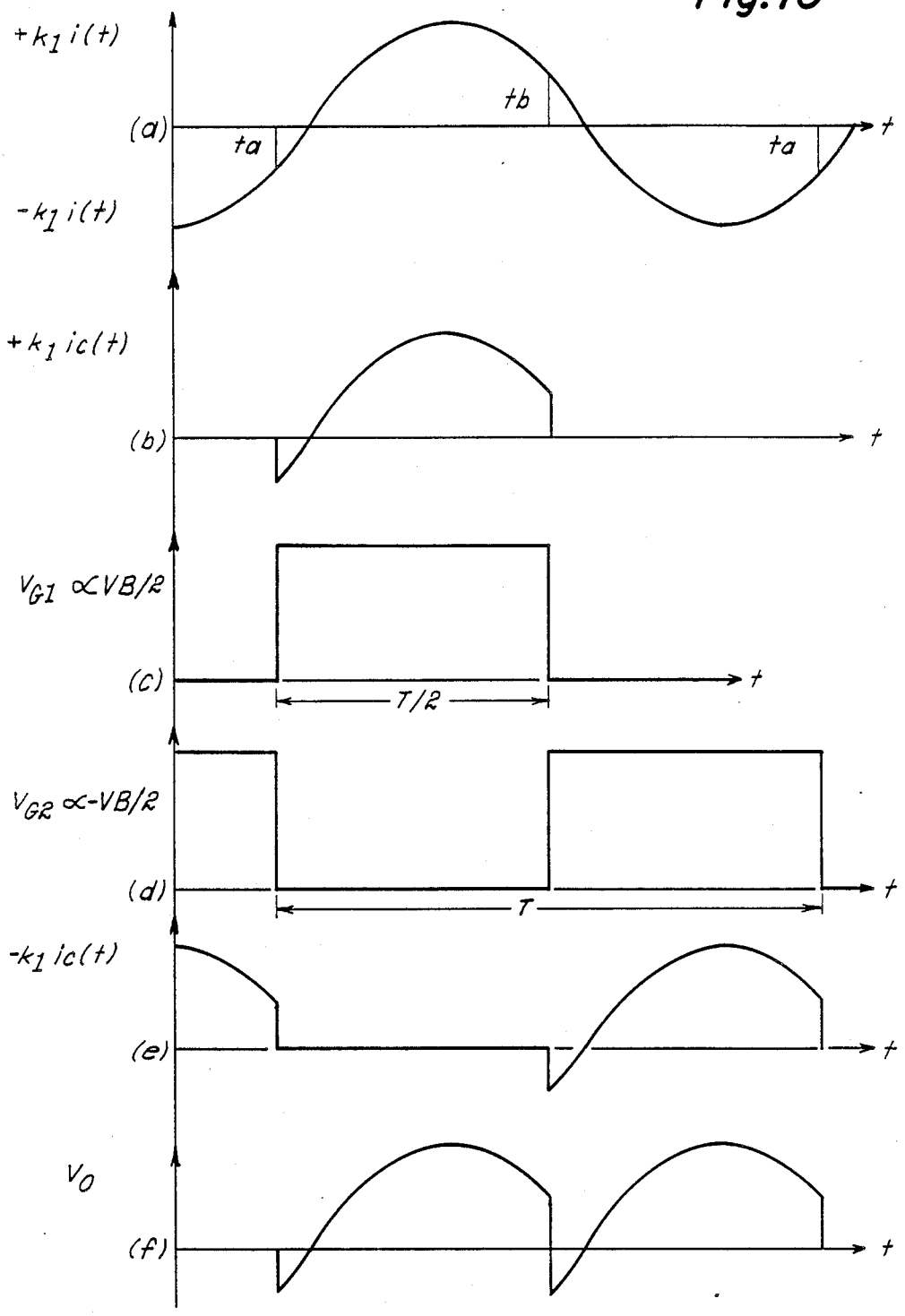
FIGS. 10(*a*), 10(*b*), 10(*c*), 10(*d*), 10(*e*) and 10(*f*) are waveforms related to the alternative embodiment of the present invention shown in FIG. 9.

The first portion of $V_o$ of FIG. 10(*f*) is developed when the gating signal $V_{G1}$, having a duration of T/2 (FIG. 10(*c*)) and which is proportional to $+V_{b/2}$ and related to phase $\phi_A$ of the power supply, is applied to FET 232 to render it conductive. The signal $V_{G1}$ then acts as a forcing function to cause the development of $k_1i_c(t)$ (FIG. 10(*b*)) which corresponds to the current $k_1i(t)$ in the lamp at the time which starts with the function $t_a$ and terminating with the function $t_b$ as shown in FIG. 10(*a*). Conversely, the second portion of $V_o$ of FIG. 10(*f*) is developed when the gating signal $V_{G2}$, having a duration of T/2 and which is proportional to $-V_{b/2}$ and related to phase $\phi_b$ of the power supply, is applied to FET 234 to render it conductive. The signal $V_{G2}$ then acts as a forcing function to cause the development of $-k_1i_c(t)$ (FIG. 10(*e*)) which corresponds to the current $-k_1i(t)$ in the lamp at the time which starts with the function $t_b$ and terminating with the function $t_a$ as shown in FIG. 10(*a*). It should be noted that the signal of FIG. 10(*e*) is a positive quantity due to the inversion operation of the transformer 238 and also that the quantities $V_{G1}(\phi_A)$ and $V_{G2}(\phi_B)$ are 180° out of phase with each other. It should be further noted that the positive quantity $V_o$ of FIG. 10(*f*) is representative of 100% of the selected power for the lamp 236 and its area above its baseline is substantially equal to the combined area above and below the baseline for the functions of FIG. 10(*a*). The relationship between $V_o$ and the power for the lamp 236 may be further described with regard to FIG. 11.

Figure 11:
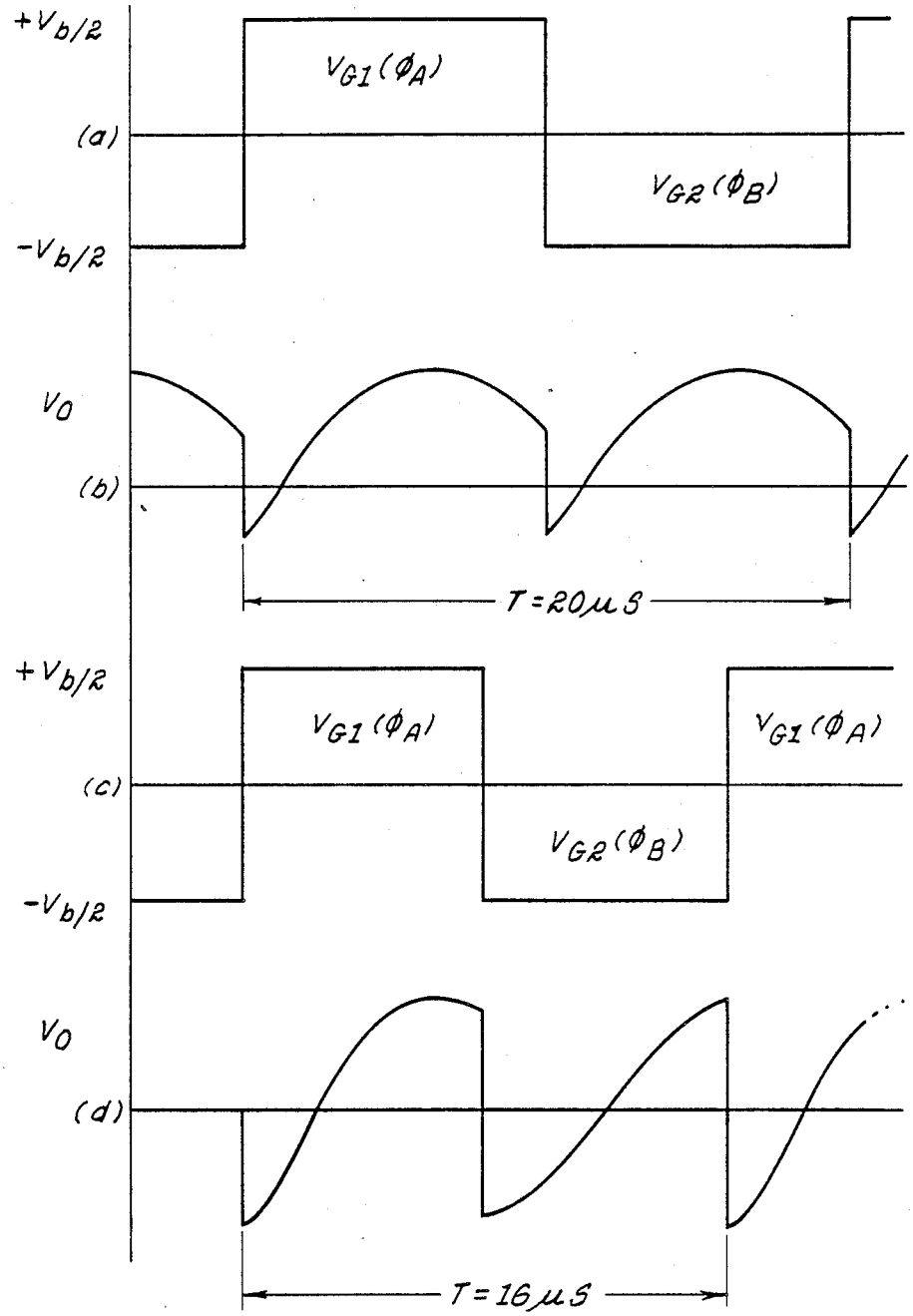
FIGS. 11(*a*), 11(*b*), 11(*c*) and 11(*d*) are graphs illustrating operating characteristics of the embodiment of the invention illustrated in FIG. 9.

FIG. 11 consists of FIGS. (*a*), (*b*), (*c*) and (*d*) which are respectively similar to FIGS. 10(*c*), 10(*f*), 10(*c*) and 10(*f*). FIG. 11(*a*) shows the gating signal $V_{G1}$ related to phase a ($\phi_A$) and $V_{G2}$ related to phase b ($\phi_B$) being respectively proportional to $+V_{b/2}$ and $-V_{b/2}$. The total duration (to) of $V_{G1}$ and $V_{G2}$ is T=20 microseconds which is shown in FIG. 11(*b*). FIG. 11(*b*) shows $V_o$ having a duration of T=20 microseconds and of a waveform quite similar to FIG. 10(*f*) which is representative of the selection of full power (100%) for lamp 236. FIGS. 11(*c*) and 11(*D*) are similar to FIGS. 11(*a*) and 11(*b*), respectively, except that the total duration (T) of $V_{G1}$ and $V_{G2}$ is 15 microseconds and the selected power for lamp 236 is reduced to a 20% value.

A comparison between $V_o$ of FIGS. 11(*b*) and 11(*d*) reveals the total area of $V_o$ related to $V_{G1}$ and $V_{G2}$ of FIG. 11(*b*) (100% POWER) is substantial all positive while the total area of $V_o$ of FIG. 11(*d*) (20% POWER) is divided above (positive) and below (negative) the baseline with the area above the baseline exceeding the area below the baseline by an amount of about 20%. The power supplied to the lamp 236 is inversely proportional to the frequency of the $V_{G1}$ and $V_{G2}$ signals. For example, to obtain the 100% power selection for lamp 236 a frequency of 50 kHz (1/20 microseconds) may be used for gating signals $V_{G1}$ and $V_{G2}$ and to obtain a 20% power selection for lamp 236 a frequency of 62.2 kHz (1/16 microseconds) may be used for gating signals $V_{G1}$ and $V_{G2}$. The frequency selected for the gating signal $V_{G1}$ and $V_{G2}$ is related to the resonant circuit of lamp 236, more particularly, to the inductance value of $L_3$, the capacitance value of $C_1$ and the resistance value R of lamp 236 which varies somewhat in accordance with its operational parameters. For example, three serially arranged fluorescence lamp 236 of a T8 type operating at 100% power may have a total resistance value of 1800 ohms, whereas, the same three lamps operated at 40% power may have a total value of 6000 ohms. The frequency selected for $V_{G1}$ and $V_{G2}$ may be further described with regard to FIG. 12.

Figure 12:
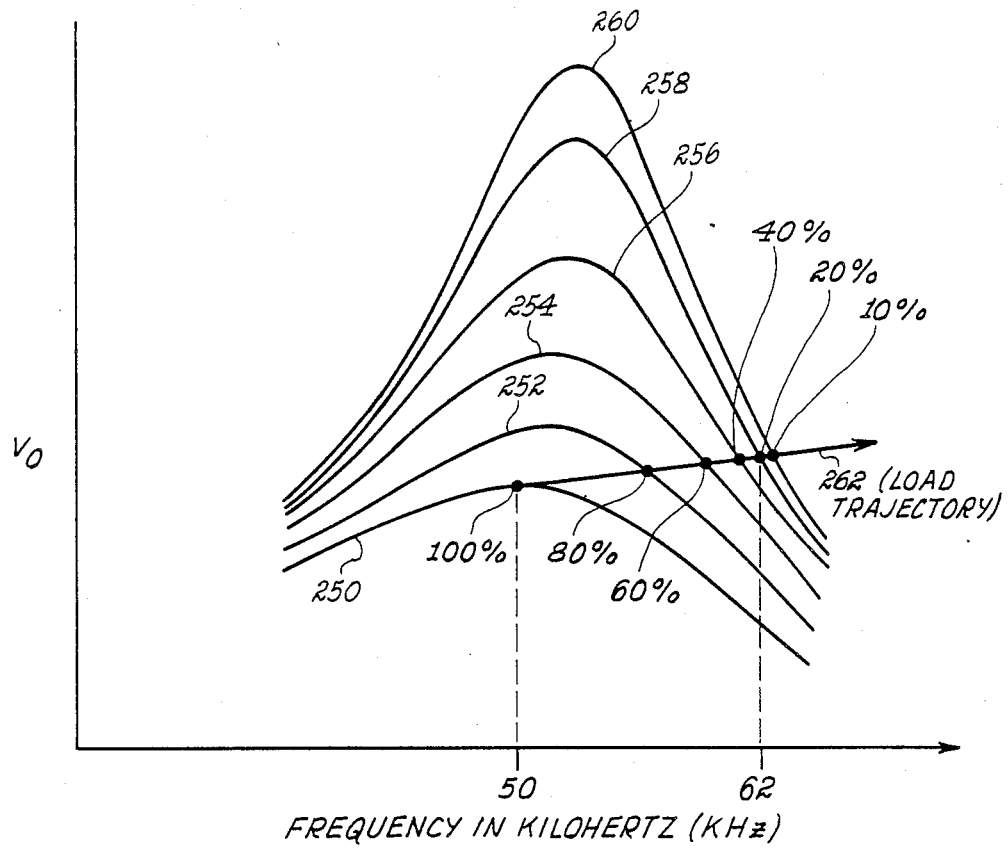
FIG. 12 shows a family of curves related to the frequencies corresponding to the operation of lamps at various power levels; and, FIG. 13 is a block diagram showing further details of the embodiment of the invention shown in FIG. 9.

FIG. 12 shows a family of curves 250, 252, 254, 256, 258, and 260 respectively corresponding to the selected power for lamp 236 of 100%, 80%, 60%, 40%, 20% and 10%. FIG. 12 has a X axis, given in kilohertz (kHz), showing the frequency related to the gating signals $V_{G1}$ and $V_{G2}$. Further, FIG. 12 has a Y axis representative of the magnitude of the output voltage $V_o$. The interrelationship between the frequency of $V_{G1}$ and VG and the selected power is shown by a load trajectory line 262 which intercepts the family of curves. For example, load trajectory line (262) intercepts curve 250 (100% POWER) at a frequency of 50 kHz, whereas, trajectory line 262 intercepts curve 258 (20% POWER) at a frequency of 62 kHz.

Figure 13:
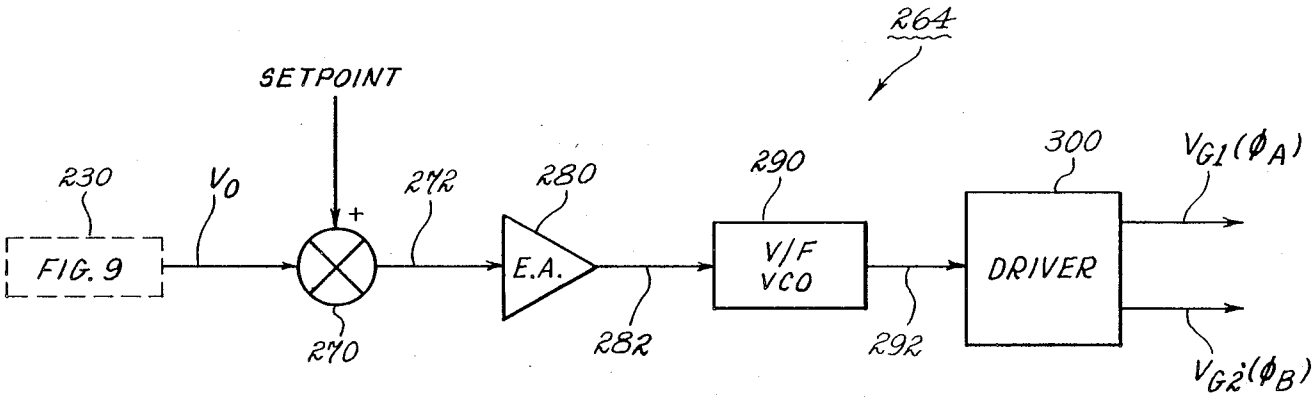

The signal $V_o$ shown in FIG. 12 and developed by the circuit arrangement 230 of FIG. 9 is routed to the circuit arrangement 264 of FIG. 13. The signal $V_o$ is of a d-c level which is indicative of the actual power delivered to the lamp 236. This voltage level is directed to the first input of a summing junction 270 with the set point SP power being directed to the second input of the summing junction. A difference, or error, signal is created in line 272 which is amplified by an error amplifier 280 to produce a voltage level signal in output 282. The signal present at output 282 is applied to a voltage control oscillator (VCO) 290 which operates in a similar manner as VCO 140. The VCO 290 produces an output signal applied to line 292 which is applied to driver 300, which, in turn, generates the gating signals $V_{G1}$ and $V_{G2}$.

The lamp power $P_L$ can be adjusted according to the frequency of the trigger pulses controlled, in turn, by voltage control oscillator 290. As the switching frequency changes in response to an error signal, the power changes in an inverse relationship. Thus, by changing the frequency of the gating signals $V_{G1}$ and $V_{G2}$ in accordance with signal $V_o$, as shown in FIG. 13, the frequency is changed to adjust the output power toward the set point SP. In this second embodiment, set point SP is adjusted for a dimming operation. The power is maintained fixed or constant at an adjusted SP level. In this fashion, the adjusted power SP is fixed. There is no drifting of the controlled power. Extinguishing of the lamp during the controlled lower power ratings is, thus, avoided or reduced.

Having thus defined the invention, the following is claimed:

1. A power control circuit for controlling the power to a discharge lamp from a power supply including a d-c input stage and a power switch selectively switched between a conductive state to pass current through said lamp and a non-conductive state, whereby current passing through said lamp increases when said switch is in said conductive state and decreases when said switch is in said non-conductive state, said power control circuit comprising:

current control means for creating a series of operating cycles (T) including a first driving portion (W) wherein said switch is rendered alternately conductive and non-conductive in succession and a quiescent portion (T-W) wherein said switch is non-conductive;

means for sensing the instantaneous current through said power switch and independent of said current passing through said lamp;

means for creating a first signal proportional to average of said sensed current;

means for creating a second signal proportional to a set point power;

means for creating an error signal indicative of the difference between said first and second signals; and means for adjusting the time of said first driving portion (W) of said operating cycle (T) in accordance with said error signal whereby the output power of said power supply is continuously adjusted toward said set point power.

2. A power control circuit as defined in claim 1 wherein said current control means includes;

means for creating a preselected number (N) of current pulses through said lamp during said first driven portion (W) of each of said operating cycles (T), with each of said pulses started by a logic signal (CK), and including means for creating a succession of said logic signals (CK) at a frequency (1/P) during said first driven portion (W), said adjusting means including voltage control means for adjusting the frequency (1/P) of said logic signals (CK) to thereby change the duration of said first portion (W) without changing said preselected number (N).

3. A power control circuit as defined in claim 2 wherein said current control means further includes means related to each of said current pulses for supplying a d-c electrical increasing current to said lamp until a predetermined high current limit is reached, then supplying a d-c electrical decreasing current until the next successive logic signal (CK) is created and continuing in a cyclic manner said increasing and decreasing d-c current until said preselected number (N) of current pulses is reached.

4. A power control circuit as defined in claim 3 wherein said lamp current flows in a closed loop and said means for sensing the instantaneous current further includes a current sensing element adjacent said switch and outside said closed loop.

5. A power control circuit as defined in claim 4 wherein said current sensing element is a resistor in series with and electrically adjacent to said switch.

6. A power control circuit as defined in claim 2 wherein said lamp current flows in a closed loop and said means for sensing the instantaneous current further includes a current sensing element adjacent said switch and outside said closed loop.

7. A power control circuit as defined in claim 6 wherein said current sensing element is a resistor in series with and electrically adjacent to said switch.

8. A power control circuit as defined in claim 1 wherein said lamp current flows in a closed loop and said means for sensing the instantaneous current further includes a current sensing element adjacent said switch and outside said closed loop.

9. A power control circuit as defined in claim 8 wherein said current sensing element is a resistor in series with and electrically adjacent to said switch.

10. A power control circuit as defined in claim 8 wherein said means for creating a first signal is a low pass filter.

11. A power control circuit as defined in claim 6 wherein said means for creating a first signal is a low pass filter.

12. A power control circuit as defined in claim 4 wherein said means for creating a first signal is a low pass filter.

13. A power control circuit as defined in claim 2 wherein said means for creating a first signal is a low pass filter.

14. A power control circuit as defined in claim 1 wherein said means for creating a first signal is a low pass filter.

15. A power control circuit as defined in claim 4 including means for sensing the voltage of said d-c input stage and means for adjusting said second signal in response to change in said sensed voltage.

16. A power control circuit as defined in claim 1 including means for sensing the voltage of said d-c input stage and means for adjusting said second signal in response to change in said sensed voltage.

17. A power control circuit for a discharge lamp to be operated by an electrical power supply having a d-c input stage with given voltage and an output power controlled by a switching frequency of power switch means in said power supply, said power supply including adjustable pulse creating means for creating current pulses at said switching frequency, said power control circuit comprising:

means for sensing the instantaneous output current of said power supply itself, said output current comprising said current pulses at said switching frequency;

means controlled by said sensed instantaneous output current of said power supply for creating a first signal with a value proportional to the actual power being supplied by said power supply to said lamp;

means for creating a second signal with a value proportional to a set point power;

means for creating an error signal having a value indicative of the difference between said first and second signals; and, means for adjusting said switching frequency in accordance with the value of said error signal whereby said output power of said power supply is continuously adjusted toward said set point power.

18. A power control circuit as defined in claim 17 including:

means for creating a third signal with a value proportional to said given voltage of said d-c input stage and means for adjusting the value of said second signal in accordance with the value of said third signal.

19. A power control as defined in claim 18 wherein means for creating said first signal is a low pass filter for averaging said output current.

20. A power control as defined in claim 17 wherein means for creating said first signal is a low pass filter for averaging said output current.

21. A power control circuit for a discharge lamp in a closed inductive loop and operated by an electrical power supply having a d-c input stage with a given voltage and an output power controlled by a switching frequency of a power switch means in said power supply whereby d-c current flows to said closed loop when said switch means is conductive and no current flows from said power supply to said closed loop when said switch means is non-conductive, said power control circuit comprising;

means for sensing the current flowing through said switch means;

means controlled by said sensed switch current for creating a first signal with a value proportional to the actual power being supplied by said power supply to said closed loop;

means for creating a second signal with a value proportional to a set point power;

means for creating an error signal having a value indicative of the difference between said first and second signals; and, means for adjusting said switching frequency in accordance with the value of said error signal whereby said output power of said power supply is continuously adjusted toward said set point power.

22. A power control circuit as defined in claim 21 including:

means for creating a third signal with a value proportional to said given voltage of said d-c input stage and means for adjusting the value of said second signal in accordance with the value of said third signal.

23. A power control circuit as defined in claim 22 wherein means for creating said first signal is a low pass filter for averaging said sensed current.

24. A power control circuit as defined in claim 21 wherein means for creating said first signal is a low pass filter for averaging said sensed current.

25. A power control circuit as defined in claim 24 including means for dimming said lamp by reducing said set point power.

26. A power control circuit as defined in claim 21 including means for dimming said lamp by reducing said set point power.

27. A method controlling the power supplied to a discharge lamp in a closed inductive loop and operated by an electrical power supply having a d-c input stage with a given voltage and an output power controlled by the switching frequency of a power switch means in said power supply whereby d-c current flows to said closed loop when said switch means is conductive and no current flows from said power supply to said closed loop when said switch means is non-conductive, said method comprising the steps of:

(a) sensing the current flowing through said switch means;

(b) creating a first signal from said sensed switch current, said first signal having a value proportional to the actual power being supplied by said power supply to said closed loop;

(c) creating a second signal with a value proportional to a set point power;

(d) creating an error signal having a value indicative of the difference between said first and second signals; and, (d) adjusting said switching frequency in accordance with the value of said error signal whereby said output power of said power supply is continuously adjusted toward said set point power.

28. The method as defined in claim 27 including the further steps of:

(f) creating a third signal with a value proportional to said given voltage of said d-c input stage; and, (g) adjusting the value of said second signal in accordance with the value of said third signal.

29. The method as defined in claim 28 wherein said step of creating said first signal includes passing said sensed current through a low pass filter to obtain an average of said sensed current.

30. The method as defined in claim 27 wherein said step of creating said first signal includes passing said sensed current through a low pass filter to obtain an average of said sensed current.

31. A method of controlling the power supplied to a discharge lamp from a power supply including a d-c input stage and a power switch selectively switched between a conductive state to pass current through said lamp and a non-conductive stage whereby current passing through said lamp increased when said switch is in said conductive state and decreases when said switch is in said non-conductive state, said method comprising the steps of:

(a) providing a current control means for creating a series of operating cycles (T) including a first driving portion (W) wherein said switch is rendered alternately conductive and non-conductive in succession and a quiescent portion (T-W) wherein said switch is non-conductive;

(b) sensing the instantaneous current through said power switch and independent of said current passing through said lamp;

(c) creating a first signal proportional to average of said sensed current;

(d) creating a second signal proportional to a set point power;

(e) creating an error signal indicative of the difference between said first and second signals; and, (f) adjusting the time of said first driving portion (W) of said operating cycle (T) in accordance with said error signal whereby the output power of said power supply is continuously adjusted toward said set point power.

32. The method as defined in claim 31 wherein said current control means includes the steps of:

(g) creating a preselected number (N) of current pulses through said lamp during said first driven portion (W) of each of said operating cycles (T), with each of said pulses started by a logic signal (CK);

(h) creating a succession of said logic signals (CK) at a frequency (1/P) during said first driven portion (W); and, (i) adjusting the frequency (1/P) of said logic signals (CK) to thereby change the duration of said first portion (W) without changing said preselected number (N).

33. A method of controlling the power supplied to a discharge lamp to be operated by an electrical power supply having a d-c input stage with given voltage and an output power controlled by a switching frequency of power switch means in said power supply, said power supply including adjustable pulse creating means for creating current pulses at said switching frequency, said method comprising the steps of:

(a) sensing the instantaneous output current of said power supply itself, said output current comprising said current pulses;

(b) using said sensed instantaneous output current of said power supply for creating a first signal with a value proportional to the actual power being supplied by said power supply to said lamp;

(c) creating a second signal with a value proportional to a set point power;

(d) creating an error signal having a value indicative of the difference between said first and second signals; and, (e) adjusting said switching frequency in accordance with the value of said error signal whereby said output power of said power supply is continuously adjusted toward said set point power.

34. The method as defined in claim 33 including the further steps of:

(f) creating a third signal with a value proportional to said given voltage of said d-c input stage; and, (g) adjusting the value of said second signal in accordance with the value of said third signal.

35. The method as defined in claim 34 wherein said step of creating said first signal includes passing said sensed current through a low pass filter for averaging said output current.

36. The method as defined in claim 33 wherein said step of creating said first signal includes passing said sensed current through a low pass filter for averaging said output current.

37. A dimmer control circuit for a discharge lamp in a closed inductive loop resonant ballast and operated by a power supply having a d-c input stage with a given voltage and an output power controlled by a switching frequency of two sets of power switches in said power supply and operated alternately at said switching frequency whereby d-c current flows to said closed resonant loop when either of said switch sets is conductive, said dimmer control circuit comprising:

means for sensing the current flowing through both of said sets of switches;

means controlled by said sensed current for creating a first signal with a value proportional to the actual power being supplied by said power supply to said closed resonant loop;

adjustable means for creating a second signal with an adjusted value proportional to a dimmer setting;

means for creating an error signal having a value indicative of the difference between said first and second signals; and, means for adjusting said switching frequency in accordance with the value of said error signal whereby said output power of said power supply is continuously adjusted toward said dimmer setting.

38. A dimmer control as defined in claim 37 wherein current sensing means comprises means for creating a first control signal when the first of said sets of switches is conducting; means for creating a second control signal when the second of said sets of switches is conducting; means for summing said first control signal with said second control signal supply to produce said first signal.

* * * * *